US005496796A

United States Patent [19]

Das

[11] Patent Number: 5,496,796

[45] Date of Patent: Mar. 5, 1996

[54] HIGH TC SUPERCONDUCTING BAND REJECT FERROELECTRIC FILTER (TFF)

[76] Inventor: Satyendranath Das, P.O. Box 574, Mt. View, Calif. 94042-0574

[21] Appl. No.: 309,979

[22] Filed: Sep. 20, 1994

[51] Int. Cl.[6] ..... H01P 1/203; H01B 12/02

[52] U.S. Cl. ..... 505/210; 505/700; 505/701; 505/866; 333/205; 333/235; 333/99 S

[58] Field of Search ..... 333/17.2, 81 A, 333/263, 99 S, 995, 204, 205, 219, 235, 110, 126, 129, 134; 505/210, 700, 701, 866

[56] References Cited

U.S. PATENT DOCUMENTS

| | | | |
|---|---|---|---|
| 4,264,881 | 4/1981 | De Ronde | 333/110 |
| 4,467,390 | 8/1984 | Carpenter, Jr. | 333/17.2 X |
| 5,328,893 | 7/1994 | Sun et al. | 333/704 X |
| 5,329,261 | 7/1994 | Das | 333/17.2 |

FOREIGN PATENT DOCUMENTS

| | | | |
|---|---|---|---|
| 5-267908 | 10/1993 | Japan | 333/219.1 |
| 1663646 | 7/1991 | U.S.S.R. | 333/17.2 |

OTHER PUBLICATIONS

Schmidt, et al; "Measured Performance at 77°K of Superconducting Microstrip Resonators and Filters"; *IEEE Trans on Microwave Theory & Technique;* MTT-39, No. 9; Sep. 1991; pp. 1475–1479.

Patel, S. D,. and Goldie, H; "A 100 kW Solid State Coaxial Limiter for L-Band Part I;" *Microwave Journal;* vol. 24, No. 12; Dec. 1981; pp. 61–65.

*Primary Examiner*—Benny T. Lee

[57] ABSTRACT

The design of a high Tc superconducting band reject tunable ferroelectric filter (TFF) is presented. The band reject TFF consists of a main microstrip line on a dielectric substrate. One or more half wavelength microstrip resonators, on a ferroelectric substrate, is coupled to the main microstrip line. At a resonant frequency of a resonator, a short circuit is presented on the main microstrip line resulting in a rejection of signal of that frequency. By applying a bias voltage to a resonator, the frequency of the resonator and, as such, the reject band of the filter is changed. Different resonators can be tuned to different frequencies.

17 Claims, 1 Drawing Sheet

HIGH TC SUPERCONDUCTING BAND REJECT FERROELECTRIC FILTER (TFF)

1. Field of Invention

The present invention relates to tunable filters of electromagnetic waves.

2. Background of the State of the Art

In many fields of electronics, it is often necessary to select and eliminate the signal of a frequency band. Commercial YIG tunable filters are available.

Ferroelectric materials have a number of attractive properties. Ferroelectrics can handle high peak power. The average power handling capacity is governed by the dielectric loss of the material. They have low switching time (such as 100 nS). Some ferroelectrics have low losses. The permittivity of ferroelectrics is generally large, and as such the device is small in size. The ferroelectrics are operated in the paraelectric phase, i.e. slightly above the Curie temperature. Inherently they have a broad bandwidth. They have no low frequency limitation as in the case of ferrite devices. The high frequency operation is governed by the relaxation frequency, such as 95 GHz for strontium titanate, of the ferroelectric material. The loss of a tunable filter is low with ferroelectric materials with a low loss tangent. A number of ferroelectric materials are not subject to burnout.

Depending on trade-off studies in individual cases, the best type of tunable fiter can be selected.

SUMMARY OF THE INVENTION

The general purpose of this invention is to provide a low loss tunable filter which embraces the advantages of similarly employed conventional devices such as YIG devices.

Another object of this invention is to design a microstrip tunable band reject filter which is a part of monolithic microwave integrated circuits (MMIC). A thin film embodiment requires a low bias voltage.

The ferroelectric material could be a ferroelectric liquid crystal (FLC) material or a solid. Candidate ferroelectrics include a mixture of strontium titanate and lead titanate, a mixture of strontium titanate and barium titanate, $KTa_{1-x}Nb_xO_3$, a composition of powdered mixture of strontium titanate and lead titanate and polythene powder, potassium dihydrogen phosphate, triglycine sulphate.

With these and other objectives in view, as will hereinafter be more particularly pointed out in the appended claims, reference is now made with the accompanying diagram.

DETAILED DESCRIPTION OF THE PREFERRED EMBODIMENT

Figure 1:
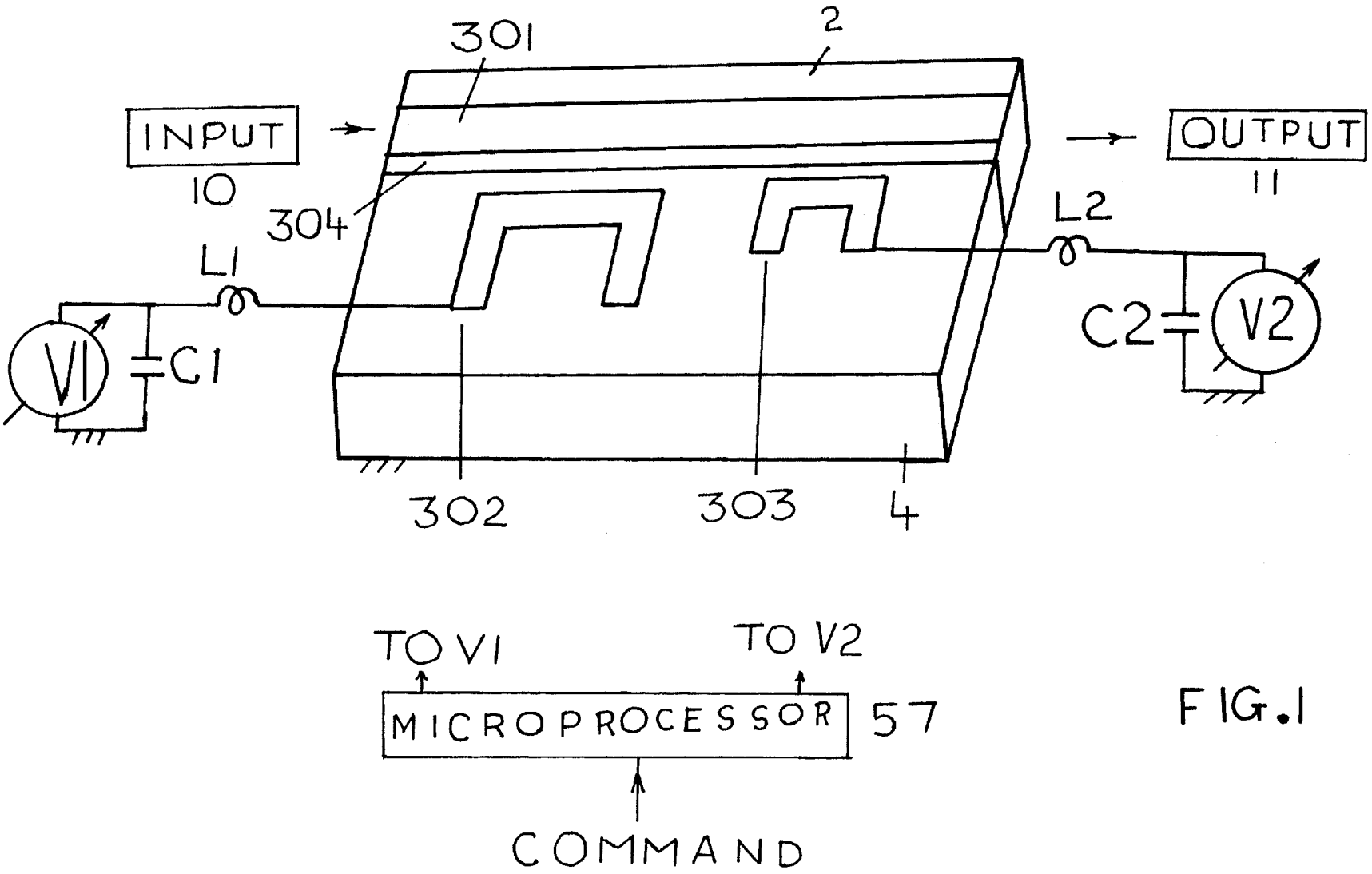
FIG. 1: Top pictorial diagram of a monolithic microstrip band reject tunable filter.

Referring now to the drawing, there is illustrated in FIG. 1 a typical microwave or millimeter wave circuit configuration that incorporates the principles of the present invention. It includes an RF input 10 and an RF output 11.

The conductors are room temperature conductors in one embodiment and high Tc superconductors, including YBCO, TBCCO in another embodiment.

In the current state of technology, a film of a single crystal high Tc superconductor can be deposited only on selected number of single crystals. The ferroelectric devices have two components of loss: (1) dielectric loss tangent and (2) conductive loss. The dielectric loss tangent is the predominant loss. If the design provides a low dielectric loss ferroelectric material on which a film of a high Tc superconductor can not be deposited, then this low loss ferroelectric is selected and the design is selected to reduce the copper conductive losses without the use of a film of single crystal high Tc superconductor on the ferroelectric material.

In FIG. 1 there is depicted an embodiment of this invention, a monolithic microstrip tunable band reject filter. The main transmission line 301 is deposited on a single crystal dielectric material 2 including sapphire and lanthanum aluminate. A half wave resonator 302 is deposited on a single crystal ferroelectric material 4 and is inductively coupled to the main transmission line 301 at the resonant frequency of the resonator 302. There is no effect on the main transmission line at frequencies outside the resonant frequency of the resonator 302. The coupling length is a small percentage of the total resonator length and is adjusted to raise or lower the bandwidth of the filter. The finite quality factor Q of the resonator gives a finite rejection. A bias voltage V1 is connected, through an L1C1 filter, to the resonator. Application of a bias voltage changes: (1) the permittivity of the ferroelectric substrate, (2) the resonant frequency of the resonator 302, and (3) the reject band of the filter. A second resonator 303 is shown in FIG. 1 which could be tuned to a different or same frequency as the first resonator depending on the requirements of the filter. A bias voltage V2 is connected, through an L2C2 filter, to the resonator 303. To eliminate or reduce the interference received at different frequencies, resonators tuned to different frequencies are used. Only two resonators are shown in FIG. 1, but 1, 2 . . . n resonators could be used. The separation distance between the centers of adjacent resonators is typically three quarters of a wavelength, at the operating frequency of the filter, or a value determined by the requirements of the filter. The bias voltages can be independently controlled by a microprocessor 57. On receipt of a command signal for operating frequencies, a microprocessor 57 controls the levels of bias voltages V1 and V2 applied to the branch line resonators. The space 304 between the resonators and the main transmission line is preferably filled with a single crystal dielectric material which is the same as that of the substrate of the main transmission line. The space 304 could also be filled with a ferroelectric material which is the same as used for the substrate of the resonators. The substrate is also in a film structure and the filter is built in a monolithic microwave integraed circuit (MMIC) technology.

It should be understood that the foregoing disclosure relates to only typical embodiments of the invention and that numerous modification or alternatives may be made, by those of ordinary skill in the art, therein without departing from the spirit and the scope of the invention as set forth in the appended claims. Different ferroelectrics, ferroelectric liquid crystals (FLC), dielectrics, impedances of microstrip lines, high Tc superconductors are contemplated.

What is claimed is:

1. A monolithic band reject tunable ferroelectric filter having electric field dependent permittivity, having different operating frequencies, an input, an output and comprising:

a main microstrip transmission line disposed on a film of a single crystal dielectric material;

a first transmission means for coupling energy into said main microstrip line at the input;

a first branch microstrip line resonator, half a wavelength long at a first operating frequency of the filter, being disposed on a film of a single crystal ferroelectric, and being coupled to and separate from the said main microstrip transmission line;

said film of a single crystal dielectric material being extended up to the said film of a single crystal ferroelectric material without leaving any airgap therebetween;

second, third, . . . nth branch microstrip line resonators, each half a wavelength long at respectively second, third . . nth operating frequencies of the filter, being disposed on the same film of a single crystal ferroelectric material as associated with said first branch microstrip line resonator and being respectively coupled to and separate from said main microstrip line;

said first, second, third, . . . nth branch microstrip line resonators being operated at separate frequencies;

in the vicinity of a resonant frequency of a corresponding said branch resonator, a low impedance is present on said main microstrip transmission line reducing the level of signal flowing through said main transmission line:

respective separation distances between centers of adjacent resonators being typically three quarters of a wavelength at an operating frequency of the filter;

conductors of said main microstrip transmission line and said microstrip line resonators being respectively comprised of a film of a conductor material;

a second transmission means for coupling energy from said main microstrip line at the output:

means, associated with the filter, for applying separate bias voltages to said first, second, third, . . . nth microstrip line resonators;

a microprocessor for controlling the separate bias voltages of said first, second, third . . . nth microstrip line resonators; and said filter being operated at a constant temperature appropriately above the Curie temperature associated with said ferroelectric material of film.

2. The monolithic band reject tunable ferroelectric filter of claim 1 wherein the single crystal ferroelectric material being $KTa_{1-x}Nb_xO_3$.

3. The monolithic band reject tunable ferroelectric filter of claim 1 wherein the single crystal ferroelectric material being $Sr_{1-x}Pb_xTiO_3$.

4. The monolithic band reject tunable ferroelectric filter of claim 3 wherein the single crystal high Tc superconductor being YBCO.

5. The monolithic band reject tunable ferroelectric filter of claim 4 wherein the single crystal dielectric material being sapphire.

6. A band reject tunable ferroelectric filter having electric field dependent permittivity, having different operating frequencies, an input, an output, and comprising:

a main microstrip transmission line disposed on a single crystal dielectric material;

a first transmission means for coupling energy into said main microstrip line at the input;

a first branch microstrip line resonator, half a wavelength long at a first operating frequency of the filter, being disposed on a single crystal ferroelectric, and being coupled to and separate from the said main microstrip transmission line;

said single crystal dielectric material being extended up to the said single crystal ferroelectric material without leaving any airgap therebetween;

second, third, . . . nth branch microstrip line resonators, each half a wavelength long at respectively second, third . . nth operating frequencies of the filter, being disposed on the same single crystal ferroelectric material as associated with said first branch microstrip line resonator and being respectively coupled to and separate from said main microstrip line;

said first, second, third, . . . nth branch microstrip line resonators being operated at separate frequencies;

in the vicinity of a resonant frequency of a corresponding said branch resonator, a low impedance is present on said main microstrip transmission line reducing the level of signal flowing through said main transmission line;

respective separation distances between centers of adjacent resonators being typically three quarters of a wavelength at an operating frequency of the filter;

conductors of said main microstrip transmission line and said microstrip line resonators being respectively comprised of a film of a single crystal high Tc superconductor material;

a second transmission means for coupling energy from said main microstrip line at the output;

means, associated with the filter, for applying separate bias voltages to said first, second, third, . . . nth microstrip line resonators;

a microprocessor for controlling the separate bias voltages of said first, second, third . . . nth microstrip line resonators; and said filter being operated at a high Tc superconducting temperature appropriately above the Curie temperature associated with said ferroelectric material.

7. The band reject tunable ferroelectric filter of claim 6 wherein the single crystal ferroectric being a ferroelectric liquid crystal (FLC).

8. The band reject tunable ferroelectric filter of claim 6 wherein the single crystal high Tc superconductor is TBCCO.

9. The band reject tunable ferroelectric filter of claim 8 wherein the single crystal dielectric is sapphire.

10. The band reject tunable ferroelectric filter of claim 6 wherein the single crystal ferroelectric material being $KTa_{1-x}Nb_xO_3$.

11. The band reject tunable ferroelectric filter of claim 10 wherein the single crystal high Tc superconductor being YBCO.

12. The band reject tunable ferroelectric filter of claim 10 wherein the single crystal high Tc superconductor being TBCCO.

13. The band reject tunable ferroelectric filter of claim 12 wherein the single crystal dielectric being sapphire.

14. A monolithic band reject tunable ferroelectric filter having electric field dependent permittivity, having different operating frequencies, an input, an output, and comprising:

a main microstrip transmission line disposed on a film of a single crystal dielectric material;

a first transmission means for coupling energy into said main microstrip line at the input;

a first branch microstrip line resonator, half a wavelength long at a first operating frequency of the filter, being disposed on a film of a single crystal ferroelectric, and being coupled to and separate from the said main microstrip transmission line;

said film of a single crystal dielectric material being extended up to the said film of a single crystal ferroelectric material without leaving any airgap therebetween;

second, third, . . . nth branch microstrip line resonators, each half a wavelength long at respectively second, third, . . nth operating frequencies of the filter, being respectively disposed on the same film of a single crystal ferroelectric material as associated with said first branch microstrip line resonator and respectively being coupled to and separate from said main microstrip line;

said first, second, third, . . . nth branch microstrip line resonators being operated at separate frequencies;

in the vicinity of a resonant frequency of a corresponding said branch resonator, a low impedance is present on said main microstrip transmission line reducing the level of signal flowing through said main transmission line;

respective separation distances between centers of adjacent resonators being typically three quarters of a wavelength at an operating frequency of the filter;

conductors of said main microstrip transmission line and said microstrip line resonators being respectively comprised of a film of a single crystal high Tc superconductor material;

a second transmission means for coupling energy from said main microstrip line at the output:

means, associated with the filter, for applying separate bias voltages to said first, second, third, . . . nth microstrip line resonators;

a microprocessor for controlling the separate bias voltages of said first, second, third . . . nth microstrip line resonators; and said filter being operated at a high Tc superconducting temperature appropriately above the Curie temperature associated with said ferroelectric material of film.

15. The monolithic band reject tunable ferroelectric filter of claim 14 wherein the single crystal ferroelectric material being $Sr_{1-x}Pb_xTiO_3$.

16. The monolithic band reject tunable ferroelectric filter of claim 15 wherein the single crystal high Tc superconductor being YBCO.

17. The monolithic band reject tunable ferroelectric filter of claim 15 wherein the single crystal high Tc superconductor being TBCCO.

* * * * *